US008939612B2

(12) United States Patent
Masuda

(10) Patent No.: US 8,939,612 B2
(45) Date of Patent: Jan. 27, 2015

(54) LUMINAIRE HAVING A SOCKET, A RADIATING MEMBER AND A REFLECTING MEMBER FIXED THEREBETWEEN

(75) Inventor: Toshifumi Masuda, Yokosuka (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 234 days.

(21) Appl. No.: 13/298,618

(22) Filed: Nov. 17, 2011

(65) Prior Publication Data

US 2012/0127731 A1 May 24, 2012

(30) Foreign Application Priority Data

Nov. 18, 2010 (JP) ..... 2010-258054

(51) Int. Cl.

| | |
|---|---|
| ***F21V 29/00*** | (2006.01) |
| ***F21S 8/02*** | (2006.01) |
| ***F21V 7/00*** | (2006.01) |
| ***F21V 17/06*** | (2006.01) |
| ***F21V 17/12*** | (2006.01) |
| ***F21V 19/00*** | (2006.01) |
| *F21Y 101/02* | (2006.01) |
| *F21V 17/00* | (2006.01) |

(52) U.S. Cl.

CPC ..... *F21V 29/004* (2013.01); *F21V 29/2212* (2013.01); *F21V 29/22* (2013.01); *F21V 29/20* (2013.01); *F21V 29/2206* (2013.01); *F21S 8/026* (2013.01); *F21V 7/00* (2013.01); *F21V 17/06* (2013.01); *F21V 17/12* (2013.01); *F21V 19/006* (2013.01); *F21V 29/2231* (2013.01); *F21V 29/24* (2013.01); *F21V 29/262* (2013.01); *F21Y 2101/02* (2013.01); *F21V 17/005* (2013.01)

USPC ..... 362/294; 362/373

(58) Field of Classification Search

CPC ..... F21V 29/00; F21V 29/20; F21V 29/22; F21V 29/2206; F21V 29/2212

USPC ..... 362/294, 373

See application file for complete search history.

(56) References Cited

U.S. PATENT DOCUMENTS

| | | | | |
|---|---|---|---|---|
| 6,575,594 | B1 | 6/2003 | Jafari | |
| 7,988,336 | B1 * | 8/2011 | Harbers et al. | 362/294 |
| 8,220,970 | B1 | 7/2012 | Khazi | |
| 8,322,897 | B2 * | 12/2012 | Blincoe et al. | 362/373 |
| 8,414,178 | B2 * | 4/2013 | Alexander et al. | 362/655 |
| 8,757,852 | B2 * | 6/2014 | Lopez et al. | 362/382 |

(Continued)

FOREIGN PATENT DOCUMENTS

| | | |
|---|---|---|
| CN | 201133639 | 10/2008 |
| CN | 101344227 | 1/2009 |

(Continued)

OTHER PUBLICATIONS

English Language Abstract of JP 2009-104958 published Apr. 14, 2009.

(Continued)

*Primary Examiner* — Robert May

(74) *Attorney, Agent, or Firm* — DLA Piper LLP (US)

(57) ABSTRACT

According to one embodiment, a luminaire includes a socket, a radiating member, and a reflecting member. The socket is adapted for loading a lamp unit therein. The lamp unit loaded in the socket contacts the radiating member. The reflecting member is sandwiched and fixed between the socket and the radiating member.

4 Claims, 3 Drawing Sheets

(56) References Cited

U.S. PATENT DOCUMENTS

| | | | | |
|---|---|---|---|---|
| 2008/0212325 | A1 | 9/2008 | Wang | |
| 2009/0310366 | A1 | 12/2009 | Huang | |
| 2010/0259919 | A1 | 10/2010 | Khazi | |
| 2013/0294095 | A1 * | 11/2013 | Thompson, III | 362/373 |

FOREIGN PATENT DOCUMENTS

| | | |
|---|---|---|
| CN | 201496852 | 6/2010 |
| CN | 101865374 | 10/2010 |
| JP | 02-044604 | 2/1990 |
| JP | 2009-104958 | 5/2009 |

OTHER PUBLICATIONS

English Language Translation of JP 2009-104958 published Apr. 14, 2009.
U.S. Appl. No. 13/298,608 captured electronically on Sep. 2012.
U.S. Appl. No. 13/298,608 electronically captured on Feb. 28, 2014.
English Language Abstract of CN 201496852 published Jun. 2, 2010.
English Language Abstract of CN201133639 published Oct. 15, 2008.
Extended European Search Report issued in EP 11189640.3 on Nov. 13, 2013.
Chinese Office Action issued in CN 201110363322.9 on Nov. 21, 2013.
English Language Translation of Chinese Office Action issued in CN 201110363322.9 on Nov. 21, 2013.
English Language Abstract of JP 02-044604 published on Feb. 14, 1990.
English Language Abstract of CN 101865374 published on Oct. 20, 2010.
English Language Abstract of CN 101344227 published on Jan. 14, 2009.
U.S. Appl. No. 13/298,608 electronically captured on Sep. 12, 2014.

* cited by examiner

LUMINAIRE HAVING A SOCKET, A RADIATING MEMBER AND A REFLECTING MEMBER FIXED THEREBETWEEN

INCORPORATION BY REFERENCE

The present invention claims priority under 35 U.S.C. §119 to Japanese Patent Application No. 2010-258054 filed on Nov. 18, 2010. The content of the application is incorporated herein by reference in their entirety.

FIELD

Embodiments described herein relate generally to a luminaire having a radiating member.

BACKGROUND

In the related art, an embedded-type luminaire such as a downlight is installed by embedding a body part of a luminaire body thereof in an embedding hole provided on a ceiling panel or the like. The body part of the luminaire body is often formed cylindrically with the same diameter. A socket is arranged in an upper part within the body part, and a light source that is removably loaded in this socket is housed within the body part.

The embedded-type luminaire is not required to have high radiation performance if the light source is an incandescent bulb. However, particularly in the case of a lamp unit using an LED element, the luminaire needs to secure sufficient radiation performance in order to restrain temperature rise in the LED element. Moreover, simply adding a radiating structure to the luminaire body to secure radiation performance of the luminaire tends to result in a complex assembly structure and may lower assemblability.

An object of some aspects of the invention is to provide a luminaire that can secure radiation performance and also can improve assemblability.

DETAILED DESCRIPTION

In general, according to one embodiment, a luminaire includes a socket, a radiating member, and a reflecting member. The socket is adapted for loading a lamp unit therein. The lamp unit loaded in the socket contacts the radiating member. The reflecting member is sandwiched and fixed between the socket and the radiating member.

Since the lamp unit loaded in the socket contacts the radiating member, heat of the lamp unit can be efficiently conducted to the radiating member, and radiation performance can be improved. Moreover, since the reflecting member is sandwiched and fixed between the socket and radiating member, these components can be assembled integrally and assemblability can be improved.

Next, an embodiment will be described with reference to FIG. 1 to FIG. 4.

Figure 1:
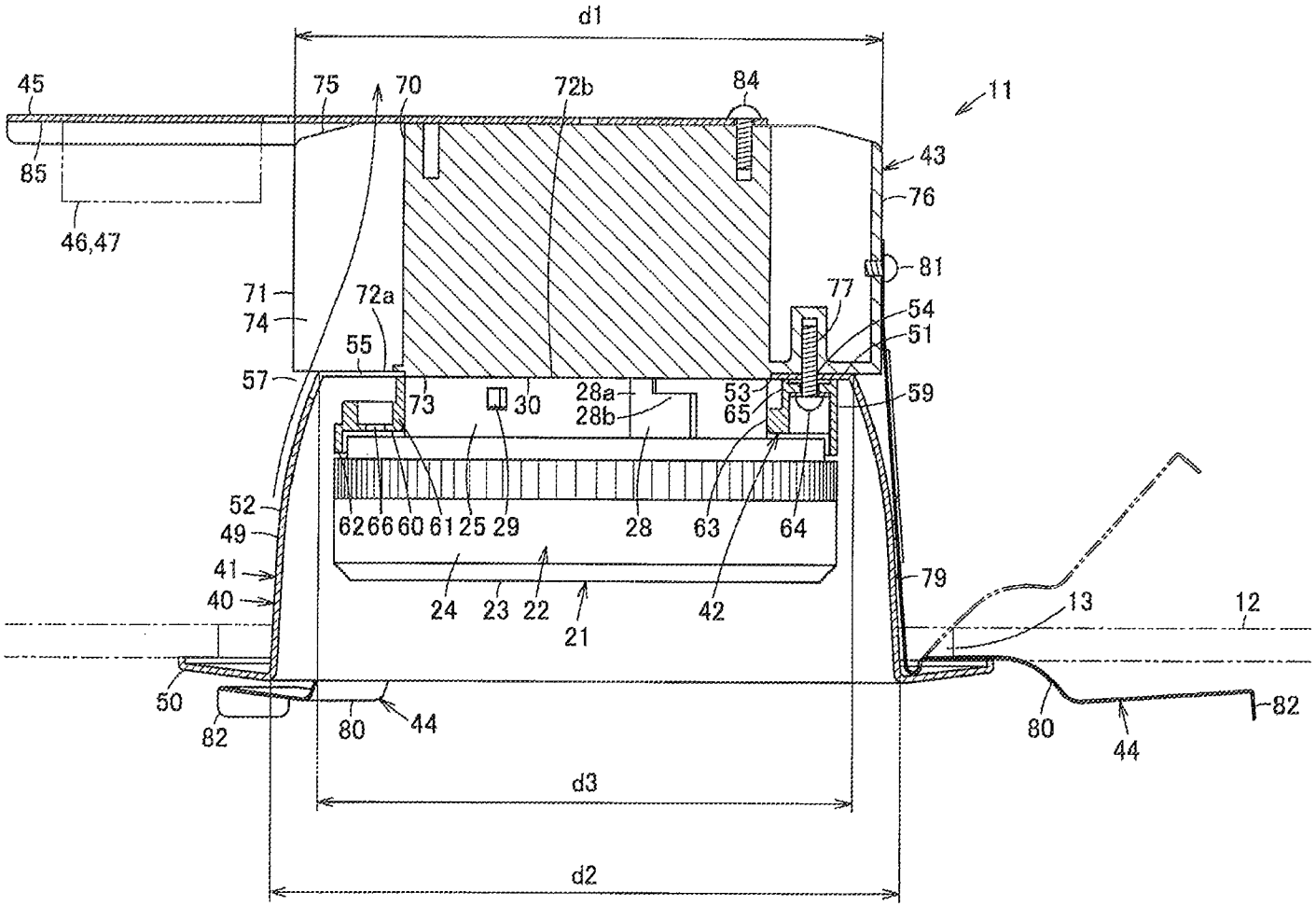
FIG. 1 is a sectional view showing a luminaire according to an embodiment.

As shown in FIG. 1, a luminaire 11 is an embedded-type luminaire such as a downlight and is installed in a state of being embedded in a circular embedding hole 13 provided in an installation target section 12 such as a ceiling panel.

As shown in FIG. 1 to FIG. 4, a flat-type lamp unit 21 is used for the luminaire 11. This lamp unit 21 has a cylindrical casing 22. A globe 23 through which light exits outside is mounted on a lower side of the casing 22.

The casing 22 has a cylindrical case 24 and a cylindrical base member 25 mounted at the center of an upper side of the case 24. The upper side of the case 24 and the base member 25 protruding from the upper side of the case 24 form a base unit 26. The casing 22 is made of, for example, an insulative synthetic resin. The base member 25 is made of, for example, a metal such as die-cast aluminum, ceramics, or a resin having excellent heat conductivity.

Inside the casing 22, a light-emitting module in which a light-emitting part including a semiconductor light-emitting element such as an LED element or EL element is formed on a board, and a lighting circuit which lights the semiconductor light-emitting element or the like are housed. The board of the light-emitting module is installed in tight contact with an inner surface of the base member 25 and thermally joined thereto.

On an upper circumferential part of the case 24, plural lamp pins 27 for power supply, for grounding and for light control signals are provided to protrude vertically.

On a circumferential surface of the base member 25, plural key grooves 28 are formed. Each key groove 28 is formed substantially in L-shape including a longitudinal groove **28*a* formed along up-down directions and continuing to the upper surface of the base member 25, and a lateral groove 28*b* formed along a circumferential direction of the base member 25 at a lower part of the base member 25. Moreover, on the circumferential surface of the base member 25, plural keys 29 are formed to protrude between the plural key grooves 28. Also, a radiator sheet 30 is mounted on the upper side of the base member 25**.

The globe 23 is made of a transmissive synthetic resin or glass. A triangular mark 31 indicating a loading position to the luminaire 11 is provided at one position on a lower side of the globe 23.

For the lamp unit 21 of this embodiment, a COB (chip on board)-type light-emitting module including plural LED elements mounted on a board is used. The input power (power consumed) of the light-emitting module is 20 to 25 W, and the total luminous flux is 1100 to 1650 lm.

Figure 2:
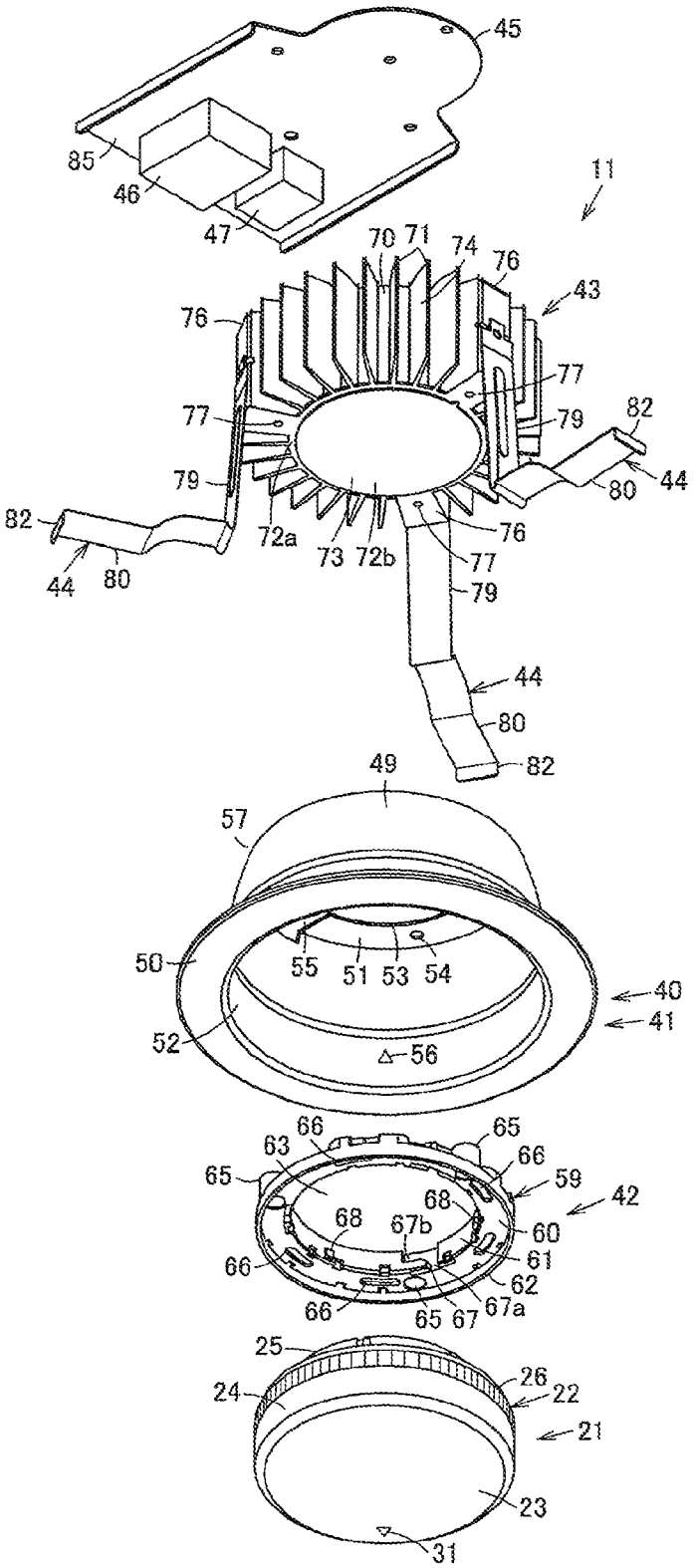
FIG. 2 is a perspective view showing a dismantled state of the luminaire.
Figure 3:
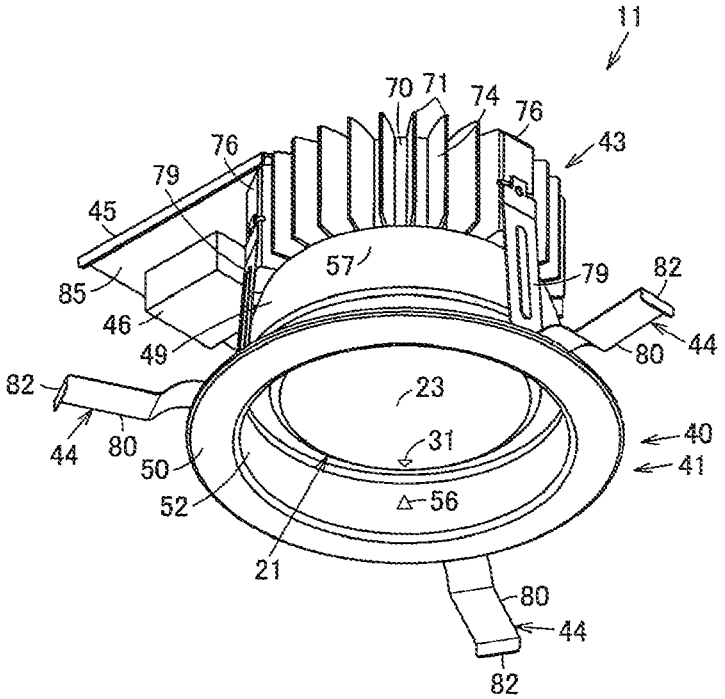
FIG. 3 is a perspective view showing an assembled state of the luminaire.
Figure 4:
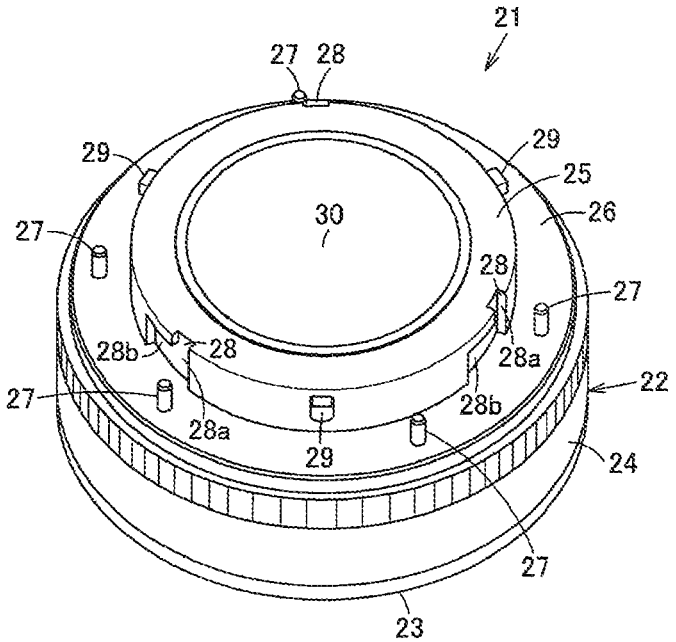
FIG. 4 is a perspective view showing a lamp unit of the luminaire.

As shown in FIG. 1 to FIG. 3, the luminaire 11 has a luminaire body 41 that is also used as a reflecting member 40, a socket 42 arranged on the inner side of the luminaire body 41, a radiating member 43 arranged in an upper part of the luminaire body 41, plural fixture springs 44 mounted on a circumferential surface of the radiating member 43, a fixture board 45 mounted above the radiating member 43, and terminal blocks 46, 47 mounted on the fixture board 45.

The luminaire body 41 is made of, for example, a metal, and has a cylindrical body part 49 and a ring-shaped flange part 50 protruding from a lower end of the body part 49 to the periphery. The body part 49 has an upper surface part 51 and a circumferential surface part 52 extending downward from a peripheral part of the upper surface part 51, and is opened downward. A circular fitting hole 53 is formed at the center of the upper surface part 51. Plural fixture holes 54 are formed in the peripheral part of the upper surface part 51. At one position in the body part 49, a wiring hole 55 is formed over the upper surface part 51 and the circumferential surface part 52. At one position on an inner circumferential surface of the body part 49, a triangular mark 56 indicating a loading position of the lamp unit 21 is provided.

The diameter of the body part 49 is smaller than the diameter of the embedding hole 13. The diameter of the flange part 50 is larger than the diameter of the embedding hole 13. The circumferential surface part 52 of the body part 49 is inclined so as to have a maximum diameter on the lower side and a gradually decreasing diameter toward the top. On an outer surface of the circumferential surface part 52 of the body part 49, a convection forming part 57 is formed which enables convection of air from the lower side toward the upper side of the radiating member 43.

The socket 42 has a ring-shaped socket body 59 that is made of, for example, an insulative synthetic resin, and plural terminals, not shown, arranged within the socket body 59.

In the socket body 59, a ring-shaped part 60 is formed. Also, an inner cylinder 61 protruding upward from an inner circumference of the ring-shaped part 60 is formed, and an outer cylinder 62 protruding downward from an outer circumference of the ring-shaped part 60 is formed. On the inner side of the inner cylinder 61, an insertion opening 63 is formed through which the base member 25 of the lamp unit 21 is inserted. An upper part of the case 24 of the lamp unit 21 can be fitted with the inner side of the outer cylinder 62.

On the ring-shaped part 60, plural bosses 65 with which plural screws 64 for fixing the socket 42, the luminaire body 41 and the radiating member 43 are screw-threaded are formed to protrude upward, and also plural connection grooves 66 in which the lamp pins 27 of the lamp unit 21 are inserted are formed in a slit shape along the circumferential direction.

On an inner circumferential surface of the inner cylinder 61, plural key grooves 67 are formed. Each key groove 67 is formed substantially in L-shape including a longitudinal groove 67*a* formed along up-down directions and continuing to the ring-shaped part 60, and a lateral groove 67*b* formed along the circumferential direction of the inner cylinder 61 at an upper part of the inner cylinder 61. Moreover, on the inner circumferential surface of the inner cylinder 61, plural keys 68 are formed to protrude between the plural key grooves 67. The key grooves 67 and the keys 68 correspond to the keys 29 and the key grooves 28 on the lamp unit 21, thus enabling the socket 42 to be removably mounted on the lamp unit 21.

Each terminal is arranged on an upper side of each connection groove 66. The lamp unit 21 is loaded in the socket 42, and each lamp pin 27 inserted in each connection groove 66 is electrically connected.

The radiating member 43 is made of, for example, a metal such as die-cast aluminum, ceramics, a resin with an excellent radiation property, or the like. The radiating member 43 includes a cylindrical basal part 70 and plural fins (radiating fins) 71 protruding radially from a circumference of the basal part 70.

On a circumferential part of the basal part 70 and a lower side of the fins 71, a fixture surface 72*a* is formed on which the upper surface part 51 of the luminaire body 41 abuts and is thus mounted. On a lower side in a central part of the basal part 70, a circular protrusion 73 is formed which closes the lower side of the basal part 70 and protrudes downward from the fixture surface 72*a*. A flat contact surface 72*b* is formed on a lower side of the protrusion 73. As the protrusion 73 and the fitting hole 53 of the reflecting member 40 fit each other, the radiating member 43 and the reflecting member 40 are positioned. On the inner side of the basal part 70, ribs, not shown, are radially formed.

Between the plural fins 71, gaps 74 opening to the outer circumference, lower side and upper side of the radiating member 43 are formed. At an upper part on the outer diameter side of the fins 71, an inclined part 75 is formed in a manner that cuts out a corner. One of the gaps 74 between the fins 71 is continued to the wiring hole 55 of the luminaire body 41.

On the outer side than the basal part 70, of the radiating member 43, plural fixture parts 76 are formed. In a lower part of each of these fixture parts 76, fixture holes 77 are formed in which the screws 64 for fixing the socket 42, the luminaire body 41 and the radiating member 43 are screw-threaded.

The radiating member 43 has such a dimensional relation that an outer diameter dimension d1 of the radiating member 43 is smaller than a maximum outer diameter dimension d2 as the maximum outer dimension of the body part 49 of the luminaire body 41 and is greater than an outer diameter dimension d3 of an upper part of the body part 49. Therefore, a portion on the outer diameter side of the fins 71 is made to protrude toward the outer diameter side from an upper outer circumferential surface of the body part 49, and the convection forming part 57 formed on the outer side of the body part 49 enables convection of air from the lower side toward the upper side of the radiating member 43.

Each fixture spring 44 is made of a metallic leaf spring and has a supporting piece 79 and an abutting piece 80 bent from a lower end of the supporting piece 79. An upper end of the supporting piece 79 is fixed to the outer side of the fixture part 76 of the radiating member 43 with a screw 81. The supporting piece 79 is thus arranged along the lateral surface of the body part 49 of the luminaire body 41. The abutting piece 80 is made to protrude toward the lateral side of the luminaire body 41. A substantially L-shaped hook part 82 is formed at a forward end of the abutting piece 80.

The fixture board 45 is made of, for example, a metal and is fixed with screws 84 in a contact with the upper side of the radiating member 43. On the fixture board 45, a terminal block fixture part 85 protruding toward the lateral side of the radiating member 43 is formed. The terminal blocks 46, 47 are mounted on a lower side of the terminal block fixture part 85. That is, with the fixture board 45, the terminal blocks 46, 47 are arranged at positions away in the lateral direction of the radiating member 43.

The terminal block 46 is for power supply and for grounding. The terminal block 47 is for light control signals. The terminal blocks 46, 47 and the socket 42 are connected with each other via an electric wire, not shown. The electric wire is connected to the terminal blocks 46, 47 from the socket 42 through the wiring hole 55 of the luminaire body 41 and the gaps 74 between the fins 71 of the radiating member 43.

Next, assembly of the luminaire 11 will be described.

The fitting hole 53 of the luminaire body 41 is fitted with the protrusion 73 of the radiating member 43, thus positioning the radiating member 43 and the reflecting member 40. The socket 42 is then inserted into the body part 49 of the luminaire body 41. In the state where the luminaire body 41 is held between the socket 42 and the radiating member 43, the screws 64 are screw-threaded in the fixture holes 77 of the radiating member 43 via the bosses 65 of the socket 42 and the fixture holes 54 of the luminaire body 41. These components are integrally fixed in the state where the luminaire body 41 is held between the socket 42 and the radiating member 43.

When inserting the socket 42 into the body part 49 of the luminaire body 41, the electric wire from the socket 42 that is drawn out in advance from the wiring hole 55 of the luminaire body 41 is connected to the terminal blocks 46, 47, and the fixture board 45 on which the terminal blocks 46, 47 are mounted is fixed to the upper part of the radiating member 43 with the plural screws 84.

Each fixture spring 44 is fixed to the lateral side of the radiating member 43 with each screw 81.

Then, the contact surface 72*b* of the radiating member 43 is arranged in an exposed state above the insertion opening 63 of the socket 42.

Next, installation of the luminaire 11 will be described.

A power supply line, a ground wire, a light control signal line and the like which are led in advance into the embedding hole 13 of the installation target section 12 are pulled out below the installation target section 12 from the embedding hole 13 and are connected to the terminal blocks 46, 47 of the luminaire 11.

In the state where the abutting pieces 80 of the fixture springs 44 are kept elastically deformed to follow the lateral surface of the luminaire body 41, first, the luminaire 11 is inclined so that the terminal block fixture part 85 of the fixture board 45 and the terminal blocks 46, 47 face upward, and the terminal block fixture part 85 of the fixture board 45 and the terminal blocks 46, 47 are inserted obliquely into the embedding hole 13. After that, while the luminaire 11 is returned to be horizontal, the radiating member 43, the body part 49 of the luminaire body 41, and the fixture springs 44 are inserted into the embedding hole 13.

As the hook parts 82 of the fixture springs 44 move up above the embedding hole 13, the fixture springs 44 are released. Thus, the abutting pieces 80 of the fixture springs 44 expand toward the lateral side of the luminaire body 41 with a repulsive force against the elastic deformation. The abutting pieces 80 abut on the upper edge of the embedding hole 13 and pull the luminaire 11 upward. The flange part 50 abuts on the lower side of the installation target section 12. The installation is thus completed.

In the luminaire 11 of this embodiment, since the maximum outer diameter dimension d1 of the radiating member 43 is made smaller than the maximum outer diameter dimension d2 of the body part 49 of the luminaire body 41, the radiating member 43 is not likely to hinder installation of, the luminaire body 41 in the embedding hole 13 of the installation target section 12. Thus, lowering of installation workability can be prevented even if the radiating member 43 is provided.

When detaching the luminaire 11 from the installation target section 12, the luminaire 11 is pulled down against the pull-up force of the fixture springs 44, and while the abutting pieces 80 of the fixture springs 44 moved down below the embedding hole 13 are elastically deformed to follow the lateral surface of the luminaire body 41, the body part 49 of the luminaire body 41 and the radiating member 43 are moved down below the embedding hole 13. Then, the luminaire 11 is inclined as in case of installation and the terminal block fixture part 85 of the fixture board 45 and the terminal blocks 46, 47 are moved down below the embedding hole 13.

Next, loading of the lamp unit 21 on the luminaire 11 will be described.

The lamp unit 21 is inserted inside the body part 49 of the luminaire body 41. The mark 31 shown on the lamp unit 21 and the mark 56 shown on the inner surface of the body part 49 of the luminaire body 41 are aligned with each other. The lamp unit 21 is pushed up and inserted into the socket 42.

Thus, first, the base member 25 of the lamp unit 21 fits in the insertion opening 63 of the socket 42. Then, the keys 68 on the socket 42 enter the longitudinal grooves 28*a* of the key grooves 28 on the base member 25, and the keys 29 on the base member 25 enter the longitudinal grooves 67*a* of the key grooves 67 on the socket 42. The lamp pins 27 on the lamp unit 21 are inserted in the corresponding connection grooves 66 on the socket 42. After that, the upper side of the base member 25 abuts on the contact surface 72*b* of the radiating member 43 via the radiator sheet 30.

In the state where the lamp unit 21 is pushed against the radiating member 43, the lamp unit 21 is rotated in a loading direction. Thus, the keys 68 on the socket 42 enter and become hooked on the lateral grooves 28*b* of the key grooves 28 on the base member 25, and the keys 29 of the base member 25 enter and become hooked on the lateral grooves 67*b* of the key grooves 67 on the socket 42. The lamp unit 21 is thus mounted on the socket 42. The lamp pins 27 on the lamp unit 21 move through the connection grooves 66 on the socket 42, then contact each terminal arranged on the upper side of the connection grooves 66 and are electrically connected thereto.

In the state where the lamp unit 21 is loaded, the upper side of the base member 25 of the lamp unit 21 is tightly in contact with the contact surface 72*b* of the radiating member 43 via the radiator sheet 30, thus enabling efficient heat conduction from the lamp unit 21 to the radiating member 43.

Meanwhile, when detaching the lamp unit 21 from the luminaire 11, first, the lamp unit 21 is rotated in a detaching direction opposite to the loading direction. Thus, the keys 68 on the socket 42 move to the longitudinal grooves 28*a* of the key grooves 28 on the base member 25, and the keys 29 on the base member 25 move to the longitudinal grooves 67*a* of the key grooves 67 on the socket 42. The lamp pins 27 move through the connection groves 66 on the socket 42 and move away from the terminals arranged on the upper side of the connection grooves 66. Subsequently, as the lamp unit 21 is moved downward, the lamp pins 27 are released from the connection grooves 66 on the socket 42. The longitudinal grooves 28*a* of the key grooves 28 on the base member 25 are released from the keys 68 on the socket 42, and the keys 29 on the base member 25 are released from the longitudinal grooves 67*a* of the key grooves 67 on the socket 42. Moreover, the base member 25 is released from the insertion opening 63 of the socket 42. Thus, the lamp unit 21 can be detached from the socket 42.

Next, lighting of the lamp unit 21 will be described.

When power is supplied to the lighting circuit via the terminal block 46, the terminals on the socket 42 and the lamp pins 27 on the lamp unit 21 from the power supply line, lighting power is supplied to the semiconductor light-emitting element of the light-emitting module from the lighting circuit and the semiconductor light-emitting element lights up. Light radiated by the lighting of the semiconductor light-emitting element is transmitted through the globe 23 and emitted from the lower opening of the luminaire body 41.

At the time of lighting, heat generated by the semiconductor light-emitting element of the light-emitting module is mainly conducted from the board of the light-emitting module to the base member 25 that is thermally joined thereto. The heat is efficiently conducted from the base member 25 to the radiating member 43 that is tightly in contact therewith via the radiator sheet 30. The heat is then radiated into the air from the surface including the plural fins 71 of the radiating member 43.

At this point, a convection current of air passing, from the lower side toward the upper side of the radiating member 43 through the gaps 74 between the plural fins 71 can be formed by the convection forming part 57 formed on the outer side of the body part 49. Therefore, the heat can be efficiently radiated from the radiating member 43.

The heat that is conducted from the lamp unit 21 to the radiating member 43 is partly conducted to the luminaire body 41, the plural fixture springs 44 and the fixture board 45. The heat is then radiated into the air from these components as well.

According to the luminaire 11 of this embodiment configured as described above, since the lamp unit 21 loaded on the socket 42 contacts the radiating member 43, the heat of the lamp unit 21 can be efficiently conducted to the radiating member 43 and radiation performance can be improved.

The maximum outer diameter dimension d1 of the radiating member 43 is made smaller than the maximum outer diameter dimension d2 of the body part 49 of the luminaire body 41. Therefore, the radiating member 43 is not likely to hinder installation of the luminaire body 41 in the embedding hole 13 of the installation target section 12 and lowering of installation workability can be prevented.

With the fixture board 45 protruding from the radiating member 43 toward the lateral side of the radiating member 43, the terminal blocks 46, 47 are arranged at positions away from the maximum outer diameter part of the body part 49 in the lateral direction of the radiating member 43. Therefore, the terminal blocks 46, 47 and the electric wires connected to the terminal blocks 46, 47 can be less likely to be thermally affected by the radiating member 43. As the electric wires connected to the terminal blocks 46, 47, generally F-cables may often be used. Since the F-cables have a maximum allowable temperature of 60 to 70° C., the electric wires connected to the terminal blocks 46, 47 are preferably made less likely to be thermally affected by the radiating member 43.

The outer diameter of the radiating member 43 is greater than the outer diameter of the upper part of the body part 49. Therefore, the surface area of the radiating member 43 increases and radiation performance of the radiating member 43 can be improved.

The convection forming part 57 formed on the outer side of the body part 49 enables convection of air from the lower side toward the upper side of the radiating member 43. Therefore, heat can be efficiently radiated from the radiating member 43 and radiation performance can be improved.

The plural fins 71 of the radiating member 43 are radially provided. Therefore, a high radiation effect can be achieved while the radiating member 43 is kept compact.

The reflecting member 40, also used as the luminaire body 41, is held and fixed between the socket 42 and the radiating member 43. Therefore, these components can easily be assembled integrally, for example, with the screws 64, and assemblability can be improved.

The contact surface 72*b* which the lamp unit 21 contacts is provided on the radiating member 43 so as to protrude from the fixture surface 72*a* which sandwiches the reflecting member 40 together with the socket 42. Therefore, the reflecting member 40 and the contact surface 72*b* can be made flush with each other, having no steps between these components. The lamp unit 21 can be securely made to tightly contact the contact surface 72*b*.

The radiating member 43 and the reflecting member 40 can be positioned by the protrusion 73 provided on the radiating member 43.

The plural fins 71 and the fixture parts 76 for mounting the socket 42 are provided on the outer side of the basal part 70 of the radiating member 43. Therefore, the lamp unit 21 can be securely made to contact the basal part 70. The heat of the lamp unit 21 can be efficiently conducted to the radiating member 43 and radiation performance can be improved.

The plural fixture springs 44 are mounted on the radiating member 43. Therefore, with these fixture springs 44, the radiating member 43, having large mass from among the components of the luminaire 11 and situated in the upper part of the luminaire body 41, can be stably supported to the installation target section 12. Moreover, since heat is efficiently conducted from the radiating member 43 to the plural fixture springs 44, a radiation effect into the air from the plural fixture springs 44 can be achieved as well and the radiation performance of luminaire 11 can be improved.

The wiring hole 55 of the luminaire body 41 and the gaps 74 between the fins 71 of the radiating member 43 are continued to each other. Therefore, the electric wires connecting the terminal blocks 46, 47 and the socket 42 can be distributed via the wiring hole 55 of the luminaire body 41 and the gaps 74 between the fins 71 of the radiating member 43 from the socket 42. Moreover, the air with increased temperature inside the body part 49 can be discharged through the wiring hole 55.

The mark 31 is provided on the lamp unit 21, and the mark 56 is provided on the luminaire body 41. Therefore, the lamp unit 21 can be easily aligned to the position where the lamp unit 21 can be correctly inserted in the socket 42.

The luminaire 11 may use a radiating fan which forces an air flow to be formed and thus effectively radiates heat with respect to the radiating member 43. In this case, power for the radiating fan may be provided from the socket 42 or the terminal block 47 for light control signals.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A luminaire comprising:

a lamp unit comprising a cylindrical case, a base member protruding from an upper side of the case, and a plurality of lamp pins protruding from an upper cicrumferential part of the case;

a socket adapted to have the lamp unit mounted thereon, the socket comprising:

a ring-shaped part defining an insertion opening through which the base member is inserted, a plurality of holes, and a plurality of connection grooves on the ring-shaped part into which the lamp pins are inserted;

a radiating member mounted to the socket by a plurality of screws which are inserted into the plurality of holes, the radiating member contacting the base member of the lamp unit inserted through the insertion opening; and a reflecting member sandwiched and fixed between the socket and the radiating member.

2. The luminaire according to claim 1, wherein the radiating member comprises a fixture surface to which the reflecting member sandwiched between the radiating member and the socket is mounted, and a contact surface which protrudes from the fixture surface and which contacts the lamp unit.

3. The luminaire according to claim 1, wherein the radiating member comprises a protrusion for positioning the reflecting member.

4. The luminaire according to claim 1, wherein the radiating member comprises a basal part, plural fins, and a fixture part, the plural fins and the fixture part provided on an outer side of the basal part, the fixture part being adapted for mounting the socket.

* * * * *